US007042426B2

(12) United States Patent
Shin

(10) Patent No.: US 7,042,426 B2
(45) Date of Patent: May 9, 2006

(54) IMAGE DISPLAY APPARATUS AND DRIVE METHOD

(75) Inventor: Dong-Yong Shin, Seoul (KR)

(73) Assignee: Samsung SDI Co., Ltd., Suwon (KR)

( * ) Notice: Subject to any disclaimer, the term of this patent is extended or adjusted under 35 U.S.C. 154(b) by 399 days.

(21) Appl. No.: 10/463,254

(22) Filed: Jun. 17, 2003

(65) Prior Publication Data

US 2003/0231152 A1 Dec. 18, 2003

(30) Foreign Application Priority Data

Jun. 18, 2002 (KR) ..... 10-2002-0033995

(51) Int. Cl.
*G09G 3/30* (2006.01)

(52) U.S. Cl. ..... 345/76; 345/83

(58) Field of Classification Search ..... 345/76–78, 345/82, 83, 87, 93–95, 204, 208; 315/169.1–169.3
See application file for complete search history.

(56) References Cited

U.S. PATENT DOCUMENTS 5,990,629 A * 11/1999 Yamada et al. ..... 315/169.3
6,937,222 B1 * 8/2005 Numao ..... 345/82
2003/0184238 A1 * 10/2003 Osame et al. ..... 315/169.3

* cited by examiner

*Primary Examiner*—Regina Liang
(74) *Attorney, Agent, or Firm*—Christie, Parker and Hale, LLP

(57) ABSTRACT

Disclosed is an image display apparatus having, in every pixel, a light-emitting element such as an organic electroluminescence (EL) element of which the brightness is controlled by a current. The image display apparatus includes transistors that form a current mirror in the pixel and using a pixel structure having two scan lines, so as to select pixels of at least two rows simultaneously, distribute the current applied to the data line to the pixel for recording display information and the adjacent pixel, and record the display information on the pixel of no more than one row among the selected pixels. This drastically increases the current for driving the data line and decreases the size of the transistors that form the current mirror in the pixel.

17 Claims, 19 Drawing Sheets

IMAGE DISPLAY APPARATUS AND DRIVE METHOD

CROSS REFERENCE TO RELATED APPLICATION

This application claims priority to and the benefit of Korean Patent Application No. 2002-0033995 filed on Jun. 18, 2002 in the Korean Intellectual Property Office, the content of which is incorporated herein by reference.

BACKGROUND OF THE INVENTION (a) Field of the Invention

The present invention relates to an image display apparatus having pixels of which the brightness can be controlled by a signal, that is, an image display apparatus with pixels each having a light-emitting element such as an organic EL (Electro-Luminescence) element of which the brightness can be controlled by a current. More specifically, the present invention relates to an active matrix type image display apparatus that controls the amount of current supplied to the light-emitting element using an active element such as an insulated gate type field effect transistor provided in each pixel.

(b) Description of the Related Art

In general, an active matrix type image display apparatus has a plurality of pixels in matrix form and controls intensity of light for each pixel according to given brightness information so as to display an image. As for an image display apparatus using liquid crystals as an electro-optic material, the transmittance of each pixel is variable depending on the voltage recorded in the pixel. The active matrix type image display apparatus using an organic EL material as an electro-optic material has the same basic operation as the liquid crystal display devices. Unlike the liquid crystal display devices, however, the organic EL image display apparatus is a self-luminous type that has a light-emitting element such as an OLED (Organic Light-Emitting Diode) in each pixel and exhibits high visibility of images and high response speed without a need for backlights. The brightness of each light-emitting element is controlled by the amount of current. For example, the organic EL image display apparatus has a striking difference from the liquid crystal display devices in that the light-emitting element is of a current-driven or current-controlled type.

Like the liquid crystal display devices, the organic EL image display apparatus uses either a simple matrix type driving method or an active matrix type driving method. The simple matrix type driving method is simple in structure but has a difficulty in realizing a large-size display device and high resolution which has led to the recent demand for the earnest development of active matrix methods. In the active matrix type driving method, the current flowing to the light-emitting element in each pixel is controlled by an active element (usually a TFT (Thin Film Transistor), which is a kind of insulated gate field effect transistor) provided in the pixel.

A variety of pixel structures have been suggested in approaches to compensate for the inter-pixel characteristic deviation of the threshold voltage of the TFT used as an active element for controlling the current flowing to the light-emitting element. The pixel structure using a current mode program system is one of them.

FIG. 1 shows a pixel structure applied to the current mode program type image display apparatus according to prior art. The pixel structure of FIG. 1 is an equivalent circuit for one pixel.

As illustrated in FIG. 1, the pixel is formed at the intersection of scan and data lines. A signal Scan for selecting the pixel is applied to the scan line with a predetermined scanning cycle, and brightness information for driving the pixel is applied in the form of a current Idata to the data line. The pixel includes one OLED used as a light-emitting element, four TFTs M1 to M4, and one storage capacitor Cst.

Once the scan line on which the pixel is positioned is selected according to the signal Scan, both the transistors M2 and M3 are turned on and the transistor M4 for controlling whether to supply the current to the OLED is turned off. The current Idata including brightness information and supplied through the data line is provided to the pixel via the transistor M3 in the "on" state. The difference between this current and a current flowing to the transistor M1 is fed back to the gate electrode of the transistor M1 via the transistor M2 in the "on" state. Then, a voltage corresponding to the current Idata is recorded on the storage capacitor Cst coupled between the gate and source electrodes of the transistor M1.

Once the scan line is unselected, the transistors M2 and M3 are turned off and the transistor M4 is turned on. The turn-off switching of the transistor M2 makes the gate electrode of the transistor M1 float and sustains the voltage recorded on the storage capacitor Cst. The transistor M1 operates in saturation region to generate a drain current according to a gate voltage. The current generated by the transistor M1 flows to the OLED via the transistor M4 in the "on" state, and the degree of light emission of the OLED is determined by the amount of the current, thereby representing a desired brightness.

In the above-described current mode program type image display apparatus according to prior art, the current for driving the data line must be equal to the current flowing to the OLED, taking a long time to drive the data line. In other words, the current mode program type image display apparatus may compensate for the characteristic deviation of mobility as well as that of threshold voltage of the transistors used in the pixel, but it takes too much time to drive the data line at a low current level and has a limitation in realizing a high-gradation and high-resolution image display apparatus.

FIG. 2 shows an image display apparatus having a pixel structure using an asymmetric current mirror for solving the above-mentioned problems.

The pixel of FIG. 2 is formed at an intersection of scan and data lines. Two scan lines are arranged for a pixel of one row. Signals Scan1 and Scan2 for selecting the pixel are applied to the scan lines with a predetermined scan cycle, and brightness information for driving the pixel is applied in the form of a current Idata to the data line. The pixel includes an OLED used as a light-emitting element, two TFTs M1 and M2 that form a current mirror, a storage capacitor Cst for storing brightness information converted from the current Idata at a voltage level, and transistors M3 and M4 for controlling the supply of the current Idata to the transistor M2 and the storage capacitor Cst, respectively.

For selecting the pixel, the signals Scan1 and Scan2 transferred via the two scan lines have a cycle for turning on the two transistors M3 and M4 almost simultaneously. The current Idata including bright information that is applied to the data line by the turn-on switching of the transistor M3 flows to the transistor M2. The turn-on switching of the transistor M4 causes a short circuit between the gate and drain electrodes of the transistor M2. The transistor M2 operates in saturation region, and a gate-source voltage corresponding to the current Idata is generated by a feedback via the transistor M4 and recorded on the storage capacitor Cst. When the two scan lines are unselected, the two transistors M3 and M4 are turned off to make the gate electrode of the transistor M2 float and sustain the voltage recorded in the storage capacitor Cst. The voltage sustained at the storage capacitor Cst is applied to the gate of the transistor M1 to generate a drain current, by which the OLED is driven.

In the image display apparatus having the above-stated pixel structure, the channel width of the transistor M2 that forms the current mirror is greater than that of the transistor M1 driving the OLED, or the channel length of the transistor M1 is greater than that of the transistor M2. In this manner, the current flowing to the transistor M2 is higher than that flowing to the transistor M1 in a predetermined proportion. Hence, the OLED can be driven with a current having a magnitude in a desired brightness range, while increasing the current used for driving the data line. But the current flowing to the data line must be several tens of times higher than the current flowing to the OLED because of a high load caused by the parasitic capacitance and the parasitic resistance of the data line. With a high ratio between the current flowing to the data line and the current flowing to the OLED, the required time for driving the data line is shortened but the size of the transistor that forms the current mirror is increased. Hence, there is a problem in that it is difficult to acquire a high aperture ratio, for example, when using a bottom emission system.

SUMMARY OF THE INVENTION

In an exemplary embodiment in accordance with aspects of the present invention, there is provided an image display apparatus that realizes high gradation and high resolution with a guaranteed high aperture ratio.

In another exemplary embodiment in accordance with aspects of the present invention, there is provided an image display apparatus that includes: a plurality of data lines for transferring a current including brightness information; a plurality of scan lines arranged to intersect the data lines; a plurality of pixels formed in a matrix form having rows and columns, each pixel being located at a different intersection of the data and scan lines, each row of pixels being coupled to corresponding first and second said scan lines, and each column of pixels being coupled to a corresponding one of the data lines, each pixel receiving at least a portion of the current transferred through the corresponding data line when selected by the corresponding first scan line, and performing a display operation according to the current supplied through the corresponding data line when selected by the corresponding second scan line; a scan driver responsive to a clock signal and a control signal for generating first signals for selecting pixels of at least two consecutive rows simultaneously and second signals for recording the brightness information on the corresponding pixels; and a data driver for generating the current including the brightness information, and applying the generated current to the corresponding data line.

In yet another exemplary embodiment in accordance with aspects of the present invention, transistors that form the current mirror are provided in the pixel and a pixel structure having two scan lines is used, thereby selecting pixels of at least two rows simultaneously, distributing the current applied to the data line to the pixel for recording display information and the adjacent pixel, and recording the display information on the pixel of no more than one row among the selected pixels. In this manner, the current for driving the data line can be drastically increased, while reducing the size of the transistors that form the current mirror in the pixel. As a result, the aperture ratio of the image display apparatus using organic light-emitting elements is enhanced.

In still another exemplary embodiment in accordance with aspects of the present invention, there is provided a light emitting device to be coupled to a date line and first and second control lines. The light emitting device includes a light emitting element; a data input for receiving a portion of a data current including brightness information on such data line, the light emitting element being responsive to said portion of the data current to adjust brightness of light emitted; a first control input for receiving a first control signal over such first control line, said first control input being responsive to said first control signal to divert said portion of the data current from such data line through the data input; and a second control input for receiving a second control signal over such second control line, said second control input being responsive to enable said portion of the data current to control the brightness of light emitted by the light emitting element.

In a further exemplary embodiment in accordance with aspects of the present invention, there is provided a method of driving an imaging display apparatus that includes a plurality of pixels arranged in a matrix form having rows and columns, said method includes: selecting a first row of pixels for a first predetermined time period; selecting a second row of pixels for a second predetermined time period, wherein the second row is adjacent to the first row, and the first and second predetermined time periods are substantially the same in duration and at least partially overlap with one another; providing a current containing brightness information to a first pixel on the first row and a second pixel on the second row while the first and second predetermined time periods overlap, wherein the current is distributed to both the first and second pixels; and selecting the first row for a third predetermined time period that overlaps with the first predetermined time period to record the brightness information on the first pixel.

BRIEF DESCRIPTION OF THE DRAWINGS

The accompanying drawings, which are incorporated in and form a part of the specification, illustrate exemplary embodiments in accordance with aspects of the present invention, and, together with the description, serve to explain the principles of the present invention.

DETAILED DESCRIPTION

In the following detailed description, exemplary embodiments of the present invention are shown and described, by way of illustration. As those skilled in the art would recognize, the described exemplary embodiments may be modified in various different ways, all without departing from the spirit or scope of the present invention. Accordingly, the drawings and description are to be regarded as illustrative in nature, and not restrictive.

Figure 3:
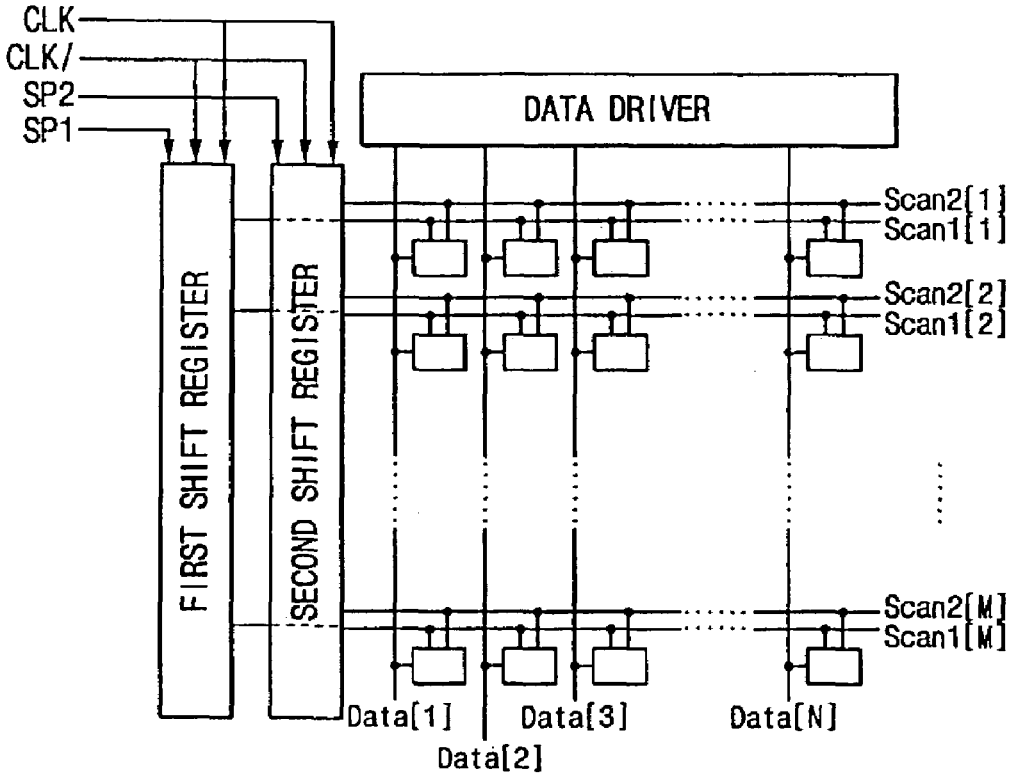
FIG. 3 is a block diagram showing the general construction of an image display apparatus in an exemplary embodiment in accordance with aspects of the present invention.

Hereinafter, the present invention will be described in detail by way of exemplary embodiments in accordance with aspects of the present invention. FIG. 3 is a block diagram showing the general construction of an image display apparatus in an exemplary embodiment in accordance with aspects of the present invention. The image display apparatus of FIG. 3 includes a plurality of data lines and a plurality of scan lines arranged to intersect, by way of example, perpendicular to, the data lines. Two scan lines are allocated to the pixels of one row, and are referred to as first and second scan lines. For example, the first and second scan lines receive Scan1[m] and Scan2[m] signals, respectively Each data line may be designated as Data[n]. The pixels are formed in an M×N matrix form at the respective intersections of the data and scan lines.

The image display apparatus includes a plurality of pixels arranged in an M×N matrix format having rows and columns. The pixels in each row are coupled to two corresponding scan lines to receive corresponding signals Scan1[m] and Scan2[m]. For example, the pixels in the first row are coupled to receive Scan1[1] and Scan2[1], the pixels in the second row are coupled to receive Scan1[2] and Scan2[2], and the pixels in the Mth row are coupled to receive Scan1[M] and Scan2[M]. Further, the pixels in each column are coupled to one of the data lines. For example, the pixels in the first column are coupled to receive Data[1], the pixels in the second column are coupled to receive Data[2], and the pixels in the Nth column are coupled to receive Data[N].

At each pixel, the current transferred through the data line is distributed when the pixel is selected by the first scan line, and a display operation is performed according to the current supplied via the data line when the pixel is selected by the second scan line. The image display apparatus also includes a scan driver for driving the scan lines. The scan driver includes first and second shift registers, which generate a signal for selecting pixels of at least two consecutive rows simultaneously and a signal for recording display information (e.g., brightness information) in the corresponding pixel according to a clock signal and a control signal, and apply the signals to the first and second scan lines, respectively.

By way of example, the first shift register receives first and second clock signals and a first control signal SP1, and according to the clock signals and the control signal SP1 generates signals for selecting at least two consecutive rows of pixels simultaneously, and applies the generated signals to the corresponding first scan lines. Similarly, the second shift register receives first and second clock signals and a second control signal SP2, and generates signals for recording the brightness information according to the clock signals and the control signal SP2, and applies the generated signals to the corresponding second scan lines.

Third and fourth shift registers may also be provided to drive the second scan line of each color component pixel of an RGB pixel. Here, the first shift register for driving the first scan line is shared by all three color component pixels of the RGB pixel. The first to fourth shift registers can be distributed on either side of the pixel region. A data driver generates a current having a current level according to brightness information and applies it to the data line.

The image display apparatus of FIG. 3 has two scan lines for each pixel of one row. One scan line is for selecting a corresponding pixel, and the other is for recording a current signal transferred via the data line on the corresponding pixel. In the described exemplary embodiment, the pixels of at least two consecutive (i.e., adjacent) rows are selected simultaneously for a predetermined time, and display information is recorded sequentially on the pixels of the respective rows according to the current signal while the pixels of the at least two rows are selected. In this manner, the current transferred via the data line is distributed to the pixels of at least two rows, reducing the size of the current transferred into each pixel.

Figure 4:
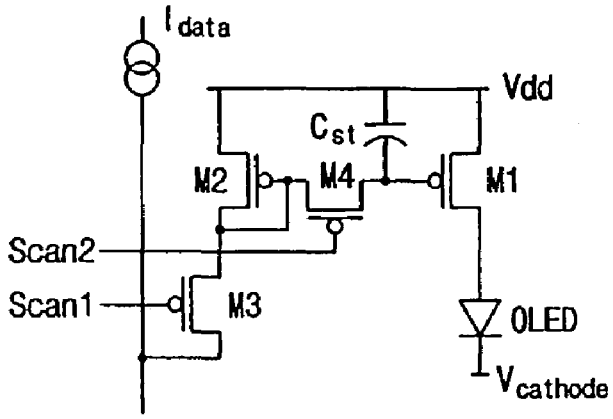
FIG. 4 is a schematic diagram showing a structure of one of the pixels shown in FIG. 3.

FIG. 4 illustrates one of the pixels of FIG. 3 in further detail. The pixel includes four transistors M1 to M4, a storage capacitor Cst, and an OLED, and is coupled over a data line to a current Idata having a current level according to brightness information, and over two scan lines, respectively, to signals Scan1 and Scan2 having a predetermined scan cycle. The scan line to which the signal Scan1 is applied is referred to as a "first scan line", and the scan line to which the signal Scan2 is applied is referred to as a "second scan line". For example, the transistors M1–M4 of FIG. 4 may be field effect transistors (FETs), and the OLED may be used as a light-emitting element for performing a display operation. In other embodiments, other types of transistors and/or light emitting element may be used. For example, the PMOS transistors that form the pixel in FIG. 4 may be replaced with NMOS transistors in other embodiments.

More specifically, the OLED has a cathode electrode coupled to a cathode voltage, and an anode electrode coupled to the drain electrode of the transistor M1. The source electrode of the transistor M1 is coupled to a power source voltage Vdd, and a storage capacitor Cst is coupled between the gate and source electrodes of the transistor M1. The transistor M2 has gate and drain electrodes coupled to each other, and a source electrode coupled to the power source voltage Vdd. The two transistors M1 and M2 form a current mirror. The gate electrodes of the two transistors M1 and M2 are coupled to the source and drain electrodes of the transistor M4, respectively, and the gate electrode of the transistor M4 is coupled to the second scan line. The drain electrode of the transistor M2 is coupled to the source electrode of the transistor M3. The transistor M3 has a gate electrode coupled to the first scan line, and a drain electrode coupled to the data line.

The above-constructed pixel has four operational conditions: (1) the case where both the two transistors M3 and M4 are ON by the first and second scan lines; (2) the case where the transistor M3 is ON and the transistor M4 is OFF; (3) the case where both the transistors M3 and M4 are OFF; and (4) the case where the transistor M3 is OFF and the transistor M4 is ON. The following is a description of the operation of the pixel of FIG. 4 in the four operational conditions of the transistors M1, M2, M3 and M4 of FIG. 4.

With the two transistors M3 and M4 ON, a current flows through the path of the transistors M2 and M3 to generate a voltage between the gate and source electrodes of the transistor M2. Of course, the gate-source voltage of the transistor M2 is dependent upon the magnitude of the drain current of the transistor M2. This voltage is transferred to the storage capacitor Cst via the transistor M4 in the "on" state, and the storage capacitor Cst applies the voltage to the gate electrode of the transistor M1. The transistor M1 generates a drain current corresponding to the gate voltage, and the drain current of the transistor M1 drives the OLED to perform a display operation with a desired brightness.

With the transistor M3 ON and the transistor M4 OFF, the gate-source voltage of the transistor M2 is not transferred to the storage capacitor Cst because the transistor M4 is in the "off" state. But, a current flows through the path of the transistors M2 and M3. In this case, the pixel performs a function of dividing the current transferred via the data line.

With the two transistors M3 and M4 OFF, the current supply to the corresponding pixel via the data line is interrupted, and the transistor M1 drives the OLED with the current corresponding to the voltage sustained by the storage capacitor Cst to continue the display operation.

With the transistor M3 OFF and the transistor M4 ON, the current supply to the corresponding pixel via the data line is interrupted, and the storage capacitor Cst is discharged by the transistors M4 and M2 to stop the display operation. The brightness can be adjusted by selecting the second scan line of the pixel during a display operation at predetermined time intervals in one frame period to interrupt the display operation. The color coordinates can also be adjusted to control the white balance by selecting the second scan lines of RGB pixels at different time intervals.

Consider now the operation of the image display apparatus in an exemplary embodiment in accordance with aspects of the present invention with reference to FIGS. 5 to 9.

Figure 5:
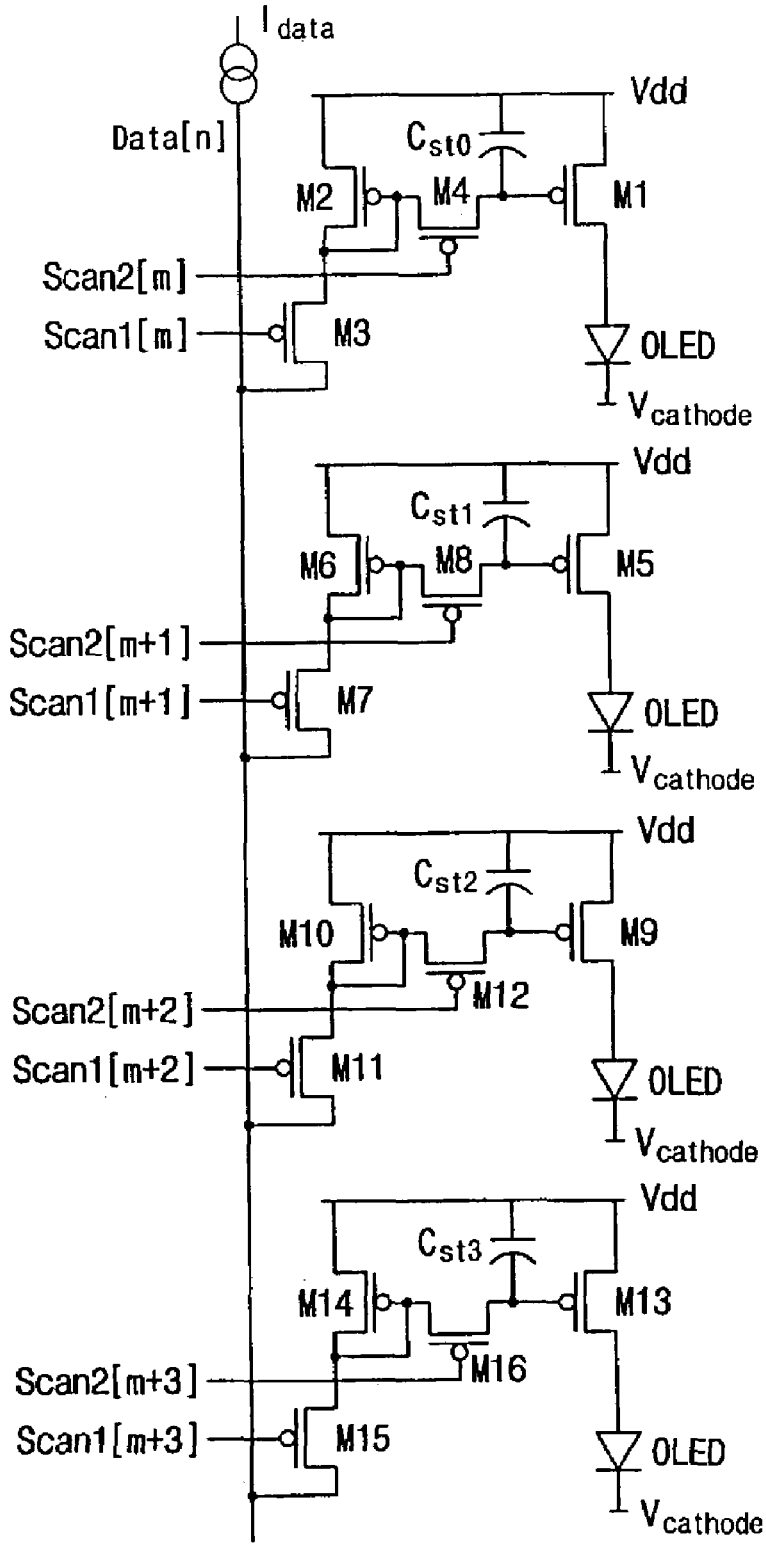
FIG. 5 is a schematic diagram showing the structure of four consecutive pixels for explaining an operation of the image display apparatus in an exemplary embodiment in accordance with aspects of the present invention.

FIG. 5 shows pixels of four consecutive rows in the image display apparatus in the exemplary embodiment. The pixels of four rows illustrated in FIG. 5 are formed at the intersections of the n-th data line and the m-th to (m+3)-th first and second scan lines.

As stated above, in the image display apparatus of FIG. 3, the pixels of at least two consecutive rows are selected simultaneously and display information is recorded on the pixel of one row during the selection period. In other words, display information is recorded on the pixel of one row while the pixels of at least two rows are selected simultaneously.

Here and elsewhere in the present application, when a reference is made to selecting two or more consecutive rows simultaneously, the term "simultaneously" does not necessarily imply that the rows have to be selected together at the same time nor does it necessarily imply that the rows have to be unselected together at the same time. Instead, the term "simultaneously" implies "present at the same time" and refers to all situations where a period for selection of one row at least partially overlaps another period for selection of at least one other row that is adjacent to the one row, regardless of whether or not the rows are selected at the same time or unselected at the same time.

Three methods of selecting pixels and recording display information will be described below. Hereinafter, the term "selection time" as used herein refers to the time period during which the pixel of one row is selected by the first scan line, and the term "recording time" as used herein refers to the time period during which the pixel of one row is selected by the second scan line for recording the display information. In the described exemplary embodiment, two rows are selected simultaneously, in which case the selection time is double the recording time. Therefore, pixels of two consecutive rows are selected during the selection time and the display information is sequentially recorded on the selected pixels of the respective rows during the recording time. If pixels of three consecutive rows are selected simultaneously, then the selection time would be three times as long as the recording time, if the pixels of four consecutive rows are selected simultaneously, then the selection time would be four times as long as the recording time, and so on.

Figure 6A:
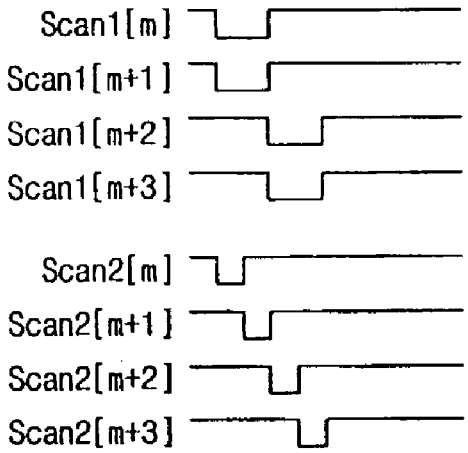
FIGS. 6A, 6B, and 6C are diagrams showing the waveforms for driving the four consecutive pixels shown in FIG. 5.
Figure 6B:
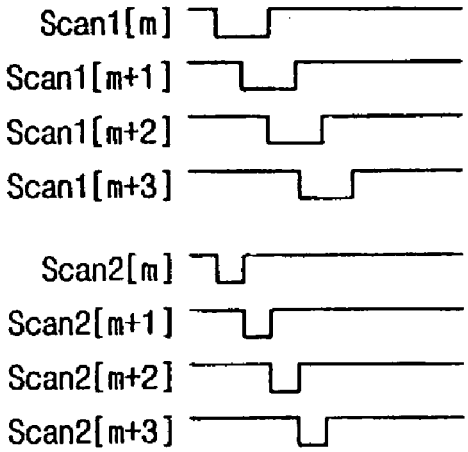
Figure 6C:
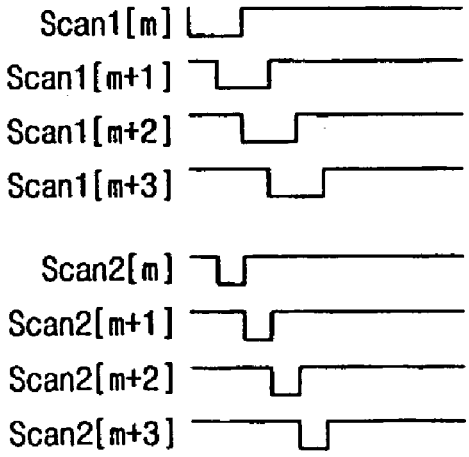

FIGS. 6A, 6B, and 6C are waveform diagrams for operating the pixel circuit of FIG. 5.

The waveform diagram of FIG. 6A illustrates a timing for selecting pixels of two rows during a defined selection time and recording display information on the selected pixels of the respective rows during a defined recording time. For example, signals Scan1[m] and Scan1[m+1] have a waveform for selecting the pixels of the m-th and (m+1)-th rows for a defined selection time, respectively, and signals Scan2[m] and Scan2[m+1] have a waveform for determining the recording time as one half of the selection time of the signals Scan1[m] and Scan1[m+1]. In the signal symbol, "[m]" represents the m-th row, "Scan1" the first scan line in a pixel, and "Scan2" the second scan line in a pixel.

In FIG. 6A, the first scan lines at the pixels of the m-th and (m+1)-th rows are selected simultaneously, and then the second scan lines at the pixels of the m-th and (m+1)-th rows are sequentially selected during the selection time. In FIG. 6B, the first scan lines at the pixels of the m-th and (m+1)-th rows are selected with an overlap of one recording time, and the second scan line at the pixel of the (m+1)-th row is selected during the overlapped time. In FIG. 6C, the first scan lines at the pixels of the m-th and (m+1)-th rows are selected with an overlap of one recording time, and the second scan line at the pixel of the m-th row is selected during the overlapped time. In the waveform diagrams of FIGS. 6B and 6C, the first scan line signals Scan1 are sequentially generated with an overlap of one recording time towards the lower row, and the second scan line signals Scan2 are then sequentially generated. Accordingly, a dummy pixel of one row is required at the pixel of the first row or the last row, when the waveform diagram of FIG. 6B or 6C is applied. The dummy pixel of one row may, for example, include only the transistors M2 and M3 (but not the transistors M1, M4 nor the capacitor Cst), and be coupled to the first scan line at the gate of the transistor M3, but not to the second scan line.

Figure 1:
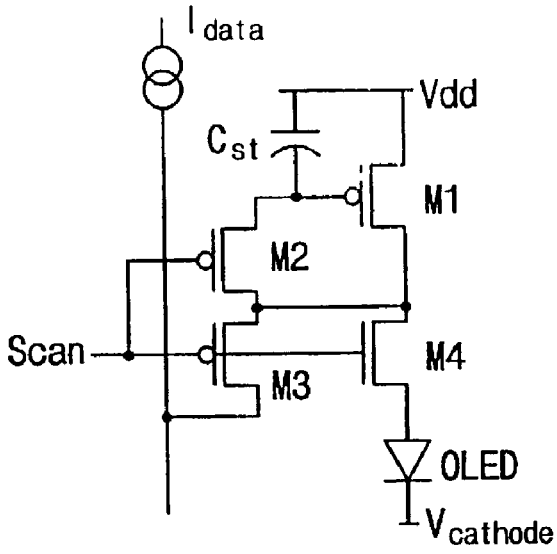
FIG. 1 is a schematic diagram showing an example of the pixel structure applied to a current mode program type image display apparatus according to prior art.
Figure 2:
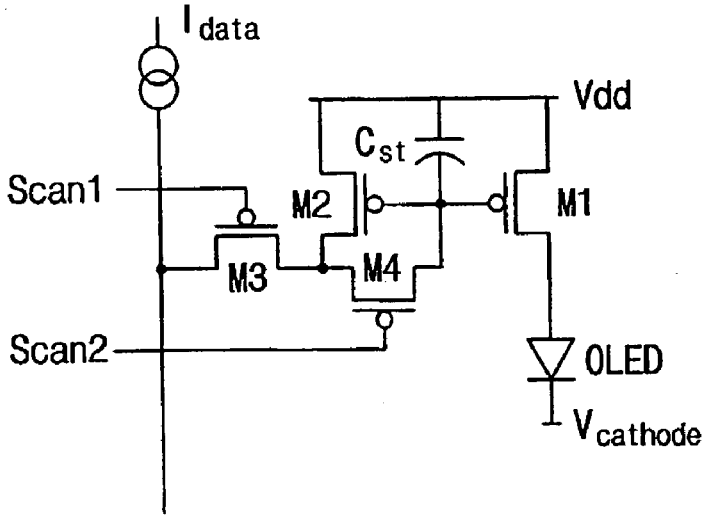
FIG. 2 is a schematic diagram showing another example of the pixel structure applied to a current mode program type image display apparatus according to prior art.

It should be noted that the waveforms shown in FIGS. 6B and 6C may also be applicable to the image display apparatus of FIG. 1.

As described above, one scan line and one data line are provided at each pixel of the image display apparatus in FIG. 1. Therefore, Scan1 signal shown in FIG. 6B or FIG. 6C may be applied to the scan line of each pixel. Although one pixel has been illustrated in FIG. 1, in practice a plurality of pixels that have the same structure as the pixel of FIG. 1 may be arranged in matrix form in an image display apparatus.

More specifically, with reference to Scan1 signals in FIG. 6B or FIG. 6C, a Scan1 signal is applied to each scan line of the image display apparatus and the Scan1 signal has selection time period and non-selection time period. Moreover, the Scan1 signals respectively applied to neighboring scan lines have their own selection time periods where the selection time periods at each continuous Scan1 signals have time period longer than one recording time and are sequential to each continuous Scan1 signals. At the same time, the selection time periods at each continuous Scan1 signals overlap each other during predetermined time, for example one recording time. During the overlapping time, data recording is performed at one pixel row of two continuous pixel rows selected by the continuous Scan1 signals.

This procedure may be illustrated as follows with reference to FIG. 1 and FIG. 6B. First, m-th pixel row is selected by Scan1[m] signal in FIG. 6B and then m-th pixel row and (m+1)-th pixel row are simultaneously selected by Scan1[m] and Scan1[m+1] signals. During the simultaneous selection time, which may be referred to as an overlapping time of each selection time at consecutive scan lines, data recording is performed at m-th pixel row. Next, (m+1)-th pixel row and (m+2) pixel row are simultaneously selected by Scan1[m+1] and Scan1[m+2] signals. During the simultaneous selection time, data recording is performed at (m+1)-th pixel row. Hence, when two consecutive pixel rows are simultaneously selected by the scan1 signals, data recording is performed at one of the selected pixel rows. At this time, division of data current is performed by the other one of the selected pixel rows. In other embodiments, more than two consecutive pixel rows may be simultaneously selected by the Scan1 signals. This way, the current transferred to each pixel row for recording data is reduced at each pixel row since the current from the data line is distributed to at least two pixel rows.

Next, the operation of the image display apparatus in the described exemplary embodiment will be given in reference to the waveforms of FIGS. 6A, 6B, and 6C and FIGS. 7A–D, 8A–D, and 9A–D. FIG. 7A-D show circuit diagrams for explaining the operation of the image display apparatus using the waveform of FIG. 6A; FIG. 8A-D show circuit diagrams for explaining the operation of the image display apparatus using the waveform of FIG. 6B; and FIG. 9A-D show circuit diagrams for explaining the operation of the image display apparatus using the waveform of FIG. 6C.

Figure 7A:
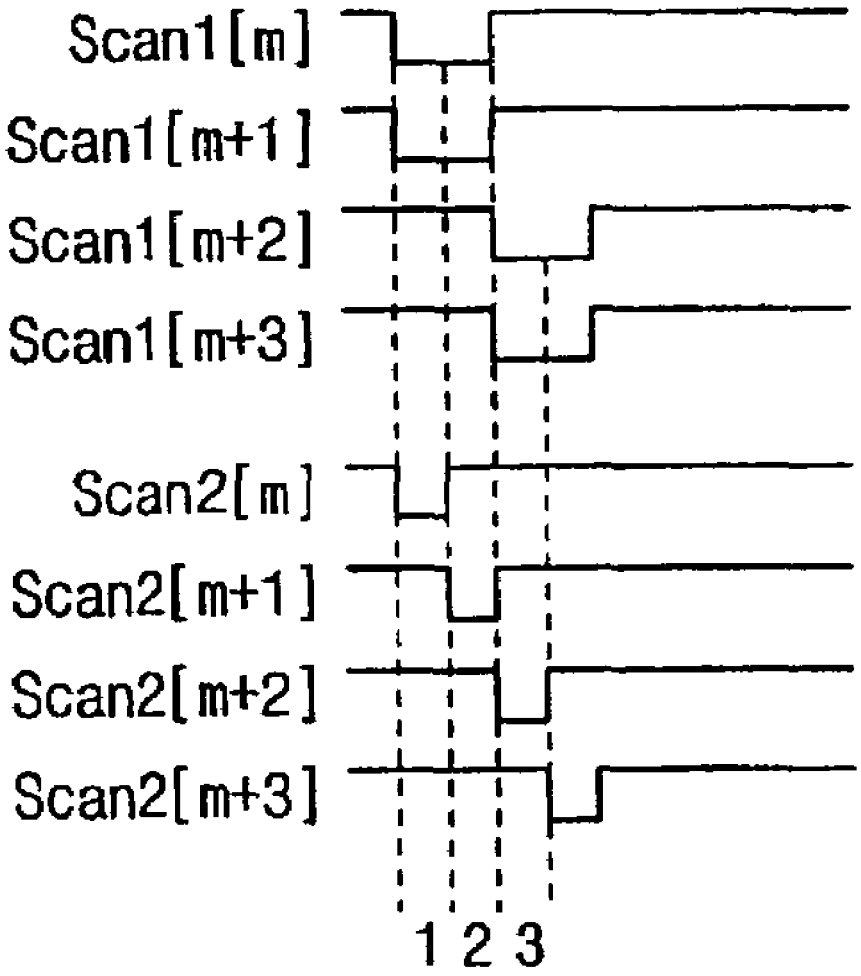
FIGS. 7A to 7D are diagrams for explaining an operation of the circuit of FIG. 5 according to the waveform shown in FIG. 6A.

FIG. 7A shows the waveform of FIG. 6A, and FIGS. 7B, 7C, and 7D show the circuit conditions at the intervals 1, 2, and 3 of FIG. 7A, respectively.

Figure 7B:
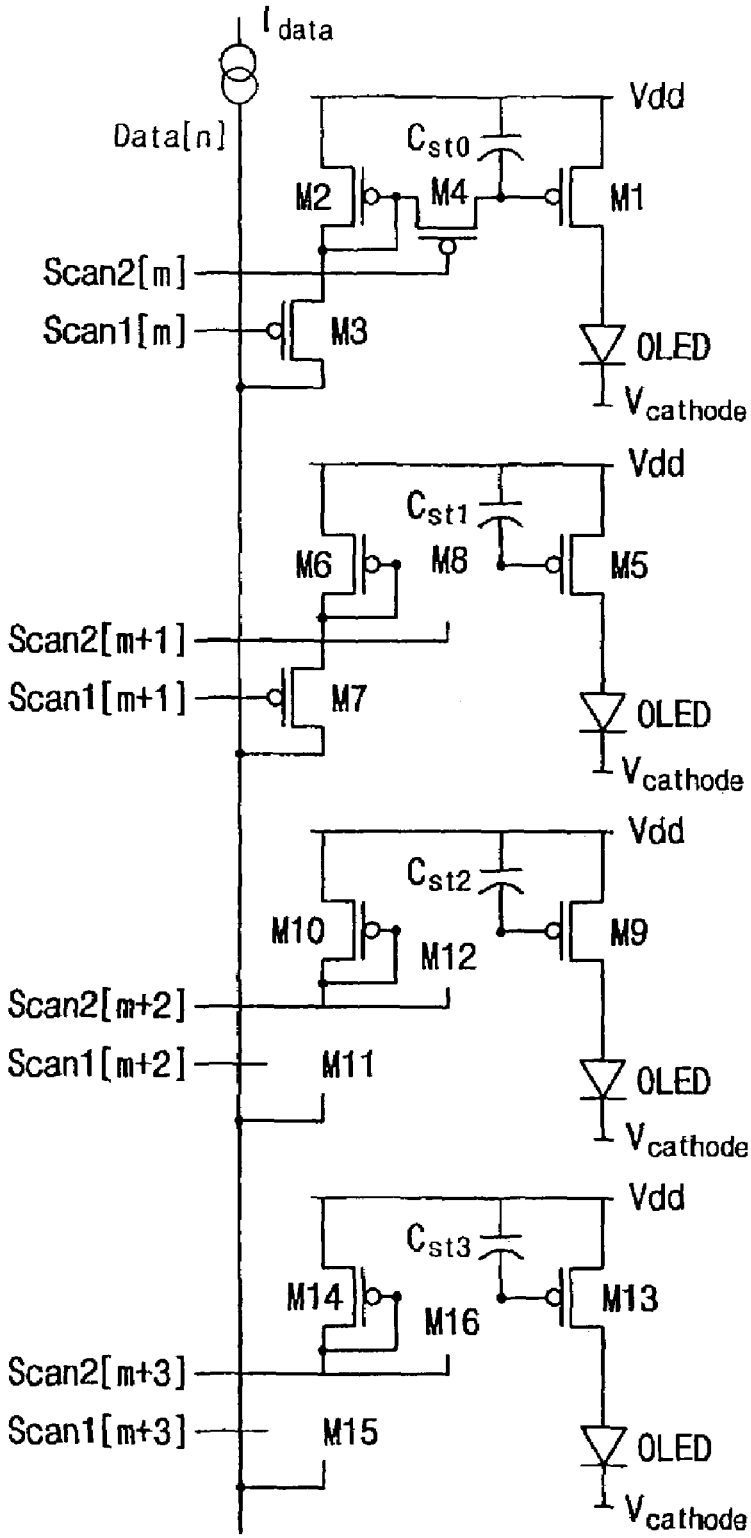
Figure 7C:
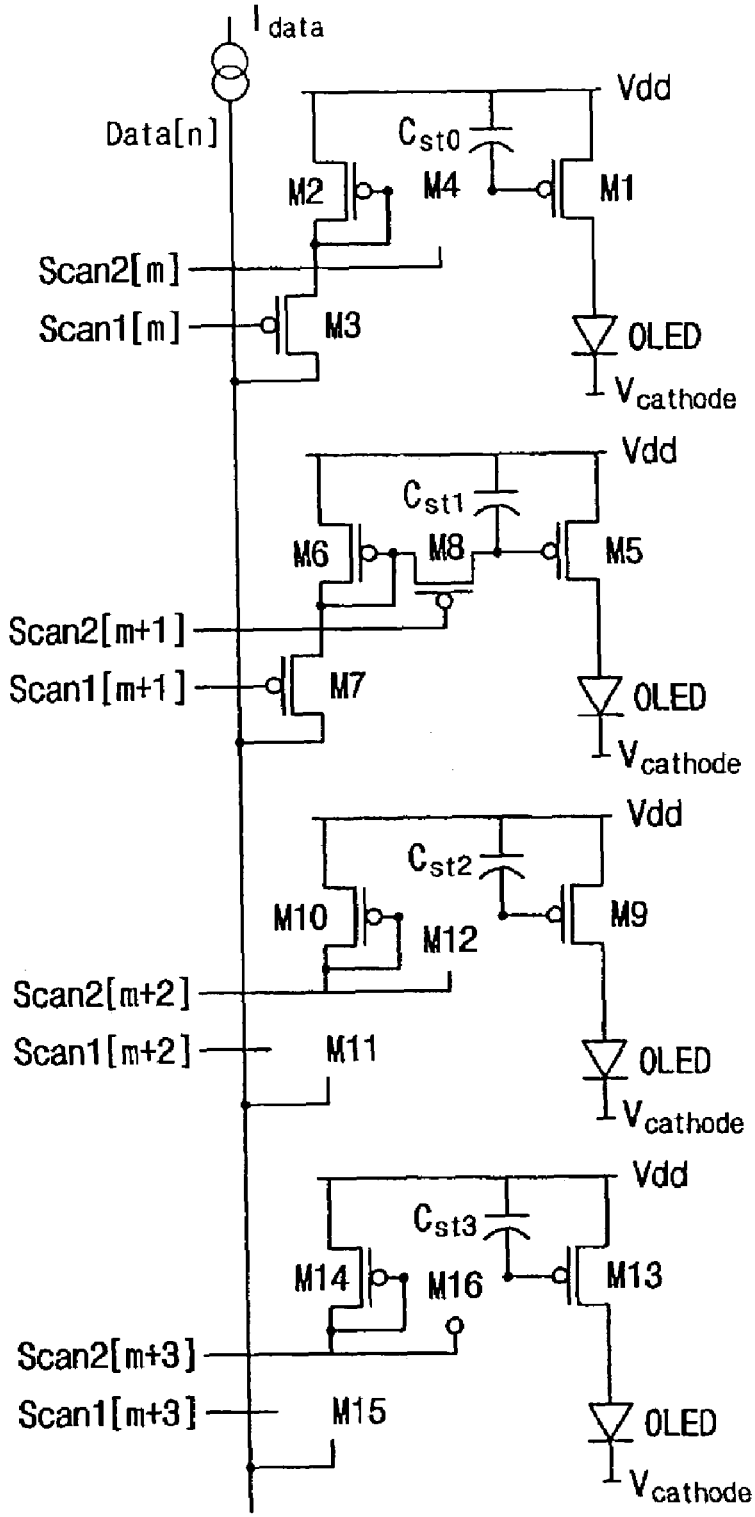
Figure 7D:
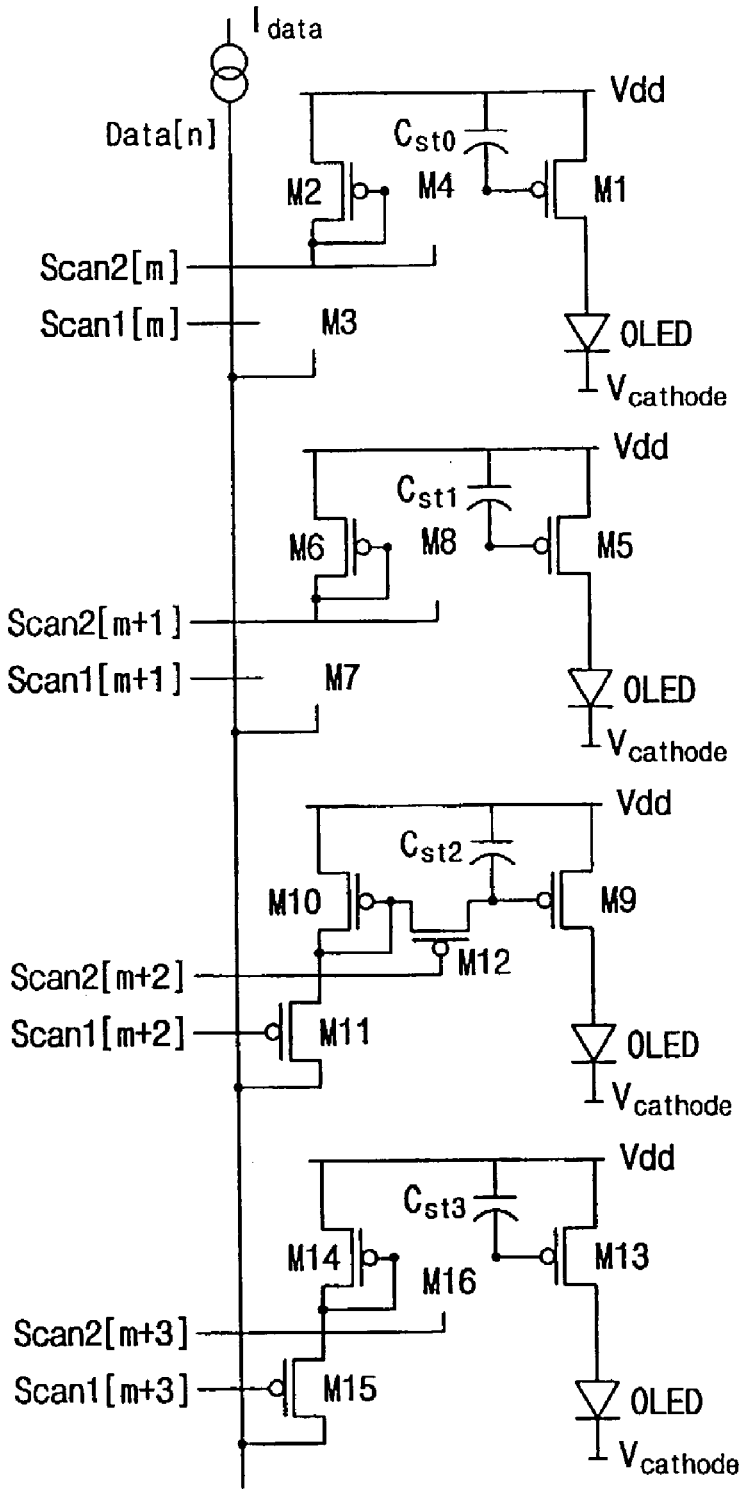

Referring to FIG. 7A, at interval 1, the signals Scan1[m] and Scan1[m+1] are selected among the first scan lines, and the signal Scan2[m] is selected among the second scan lines. The other signals are all unselected. FIG. 7B shows the switching status at the pixels of four rows at interval 1. The transistors M3 and M4 are turned on at the pixel of the m-th row and only the transistor M7 is turned on at the pixel of the (m+1)-th row. So, the current Idata supplied through the data line and including display information is distributed to the pixels of the m-th and (m+1)-th rows in substantially equal portions (i.e, half and half), and display information is recorded in the pixel of the m-th row according to the turn-on switching of the transistor M4. The detailed operation of the circuit can be understood with reference to the circuit of FIG. 4. As a result, the display information is recorded on the pixel of the m-th row at the interval 1 of FIG. 7A.

In the circuit of FIG. 7B, when the transistor M2 is the same in characteristics as the transistor M6, the transistor M3 being the same in characteristics as the transistor M7, and the resistance of the data line between the drain electrodes of the transistors M3 and M7 is zero, the current Idata of the data line is distributed to the transistors M2 and M6 in substantially equal portions. In other words, the current flowing to the transistor M2 is reduced substantially by half, so that the current ratio of transistor M2 to transistor M1 in a current mirror is also reduced substantially by half relative to the conventional method even when the data line is driven with the current of the same magnitude. The reduced current ratio of the transistors M1 and M2 that form the current mirror leads to the decreased size of the transistors M1 and M2, and hence an increase in the aperture ratio. Accordingly, in the described exemplary embodiment, pixels of at least two adjacent rows are selected simultaneously in recording the display information on the pixel of one of the selected rows to reduce the current flowing to the transistors that form the current mirror in the pixel, thereby decreasing the size of the transistors and increasing the aperture ratio of the display apparatus.

At interval 2 of FIG. 7A, the signals Scan1[m] and Scan1[m+1] are selected among the first scan lines, and the signal Scan2[m+1] is selected among the second scan lines. The other signals are all unselected. So, the current Idata of the data line flows to the pixels in the m-th and (m+1)-th rows, and the display information is recorded only on the pixel of the (m+1)-th row.

At interval 3 of FIG. 7A, the signals Scan1[m+2] and Scan1[m+3] are selected among the first scan lines, and the signal Scan2[m+2] is selected among the second scan lines. The other signals are all unselected. So, the current Idata of the data line flows to the pixels of both the (m+2)-th and (m+3)th rows, and the display information is recorded only on the pixel of the (m+2)-th row.

Figure 8A:
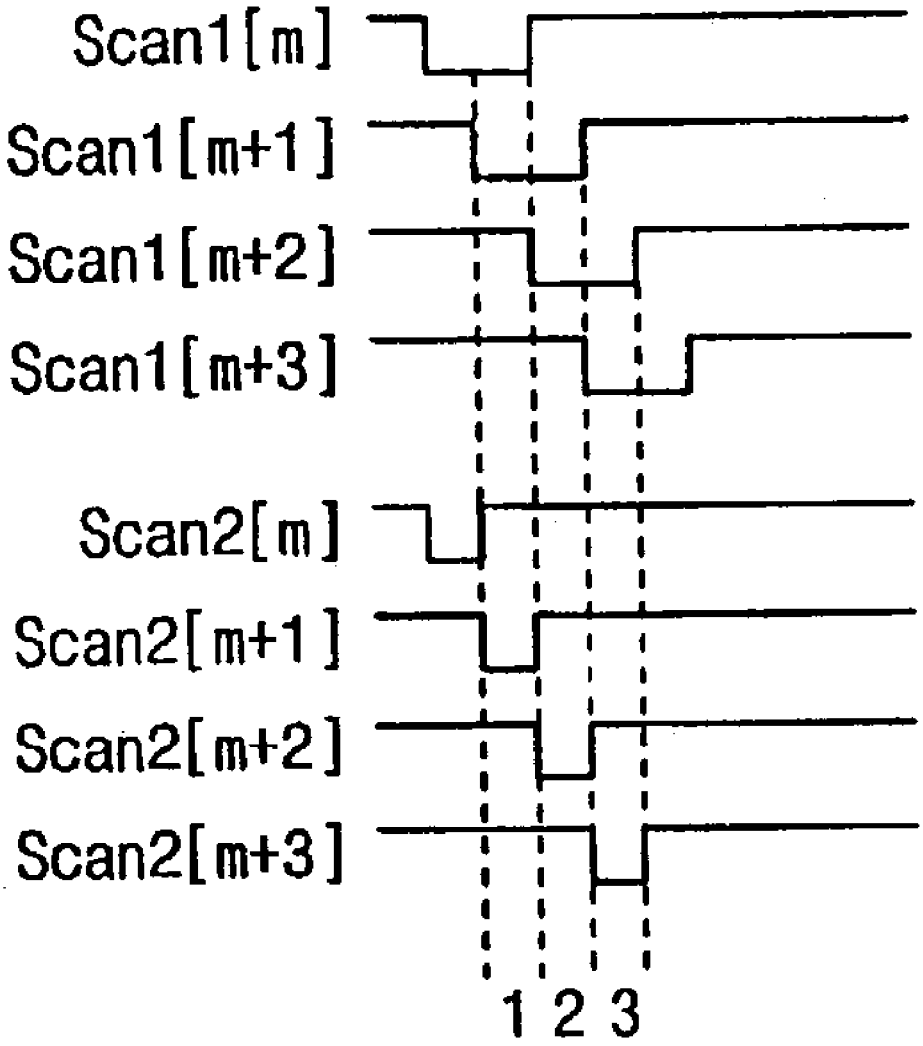
FIGS. 8A to 8D are diagrams for explaining an operation of the circuit of FIG. 5 according to the waveform shown in FIG. 6B.

FIG. 8A shows the waveform of FIG. 6B, and FIGS. 8B, 8C, and 8D show the circuit conditions at the intervals 1, 2, and 3 of FIG. 8A, respectively. In the waveform of FIG. 8A, the first scan lines at the pixels of the m-th and (m+1)-th rows are selected with an overlap of one recording time, and the second scan line at the pixel of the (m+1)-th row is selected during the overlapped time. In other words, according to the waveform of FIG. 8A, the first scan line signals select the pixels of a row for recording the display information and the previous row for one recording time. The second scan line signal sequentially selects the pixel of one row. Unlike the waveform of FIG. 7A, the first scan lines also sequentially select the pixels of two rows. With the above-constructed waveform of the first and second scan lines, the principle of the described exemplary embodiment may be achieved that the pixels of at least two rows are selected and the display information is recorded on the pixel of no more than one row.

Figure 8B:
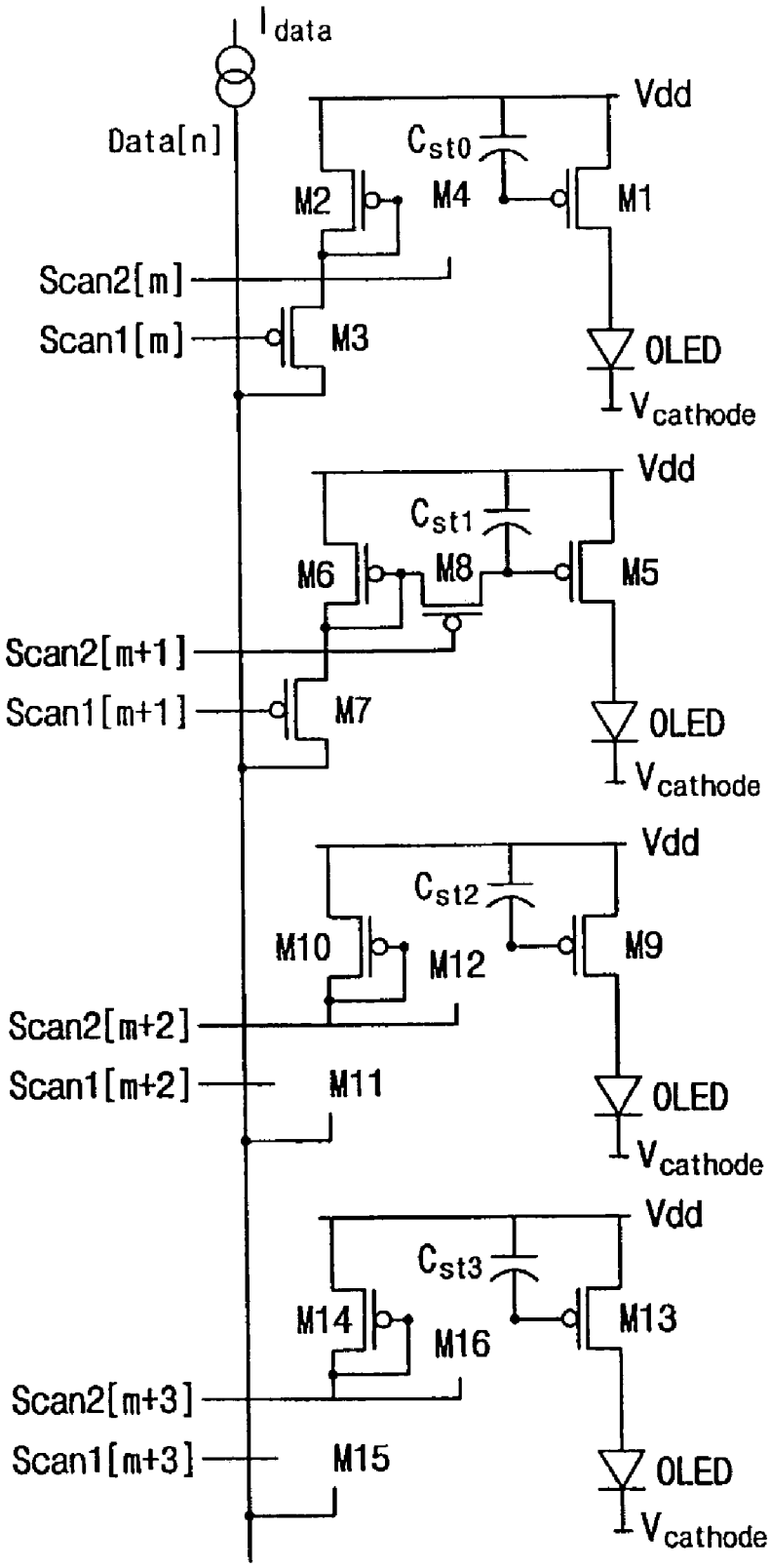
Figure 8C:
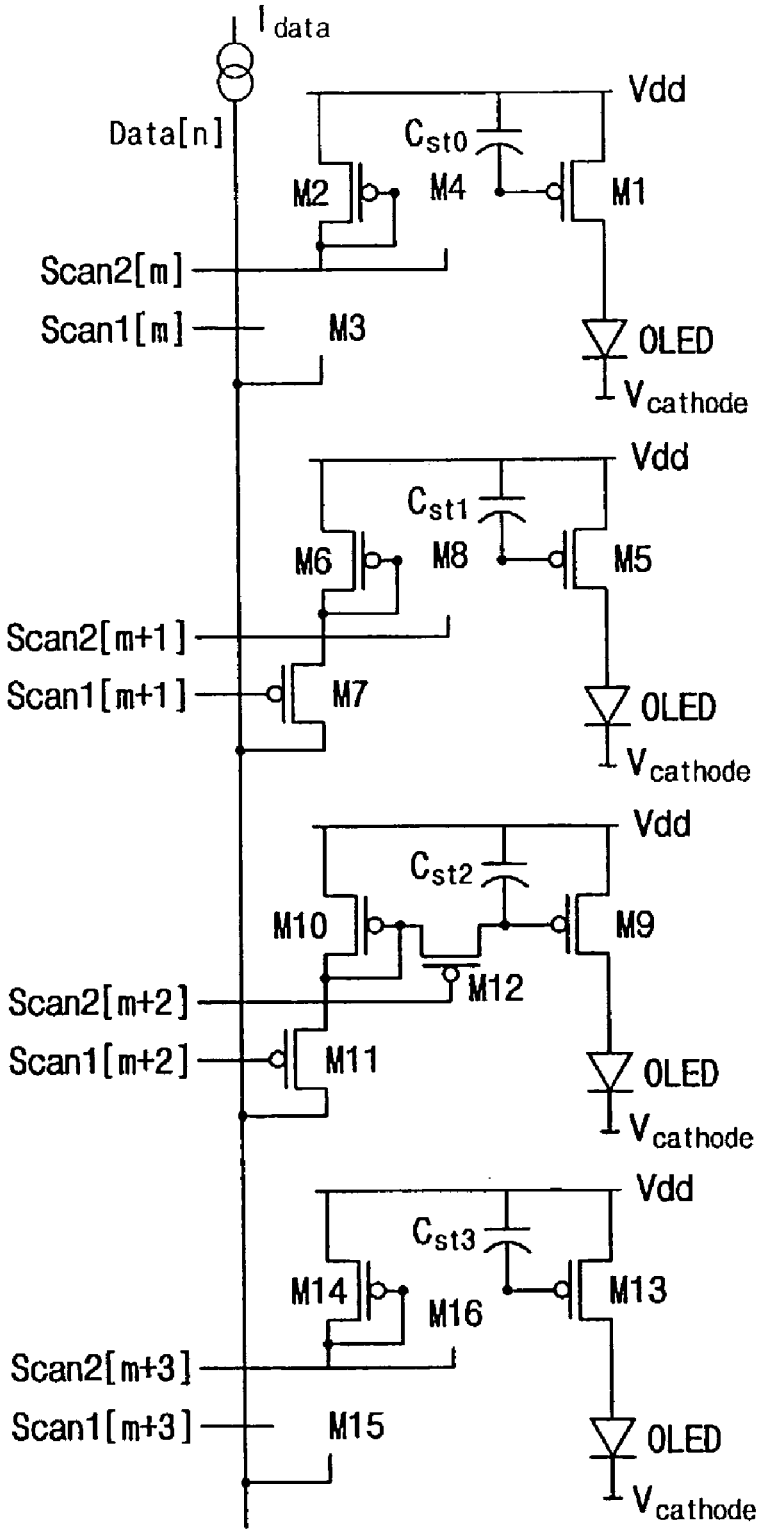
Figure 8D:
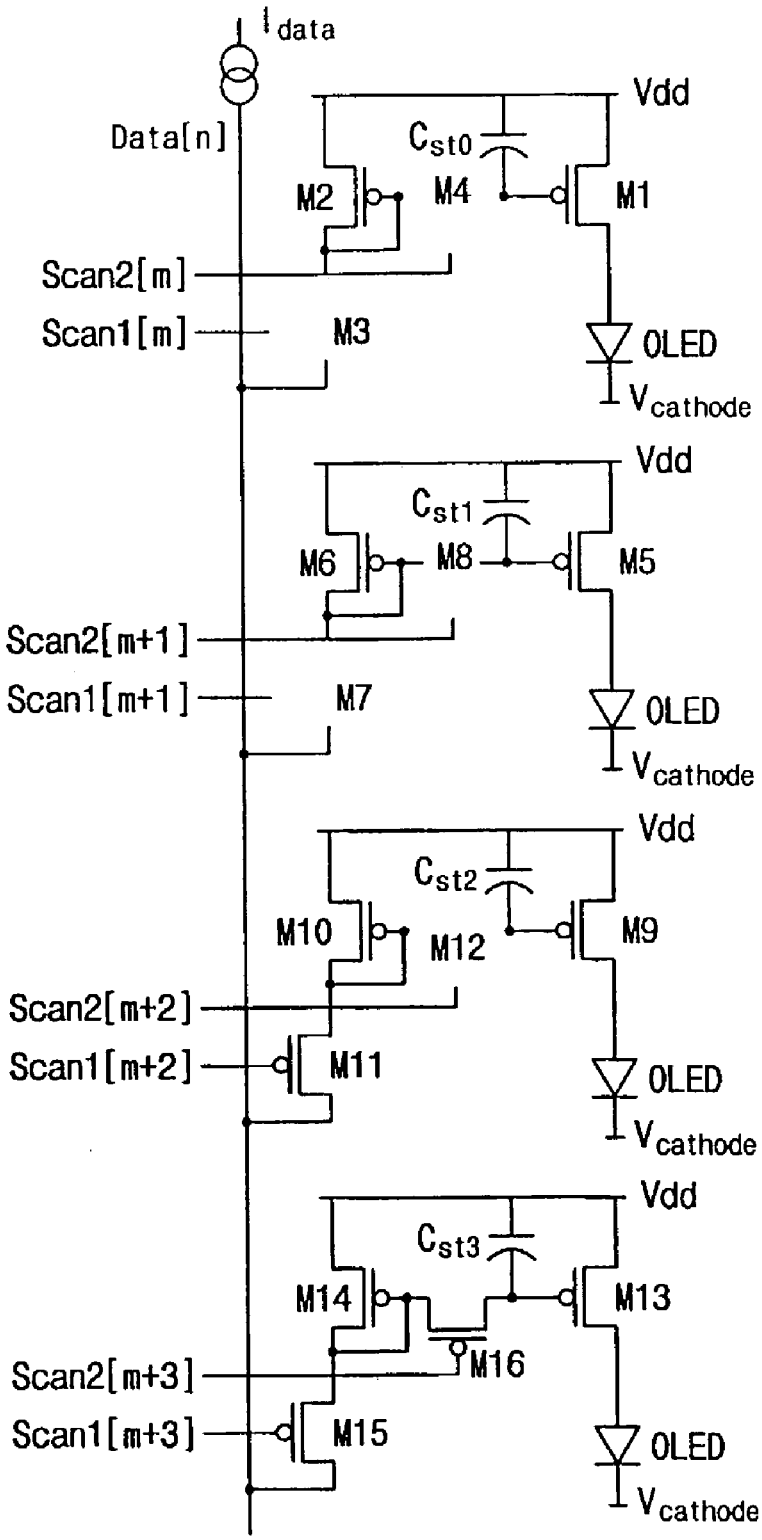

The operation at three intervals of FIG. 8A will now be described in further detail. Referring to FIGS. 8A and 8B, at interval 1, the signals Scan1 [m] and Scan1[m+1] are selected among the first scan lines, and the signal Scan2[m+1] is selected among the second scan lines. The other signals are all unselected. At the interval 1, the current Idata of the data line is distributed to the pixels of the m-th and (m+1)-th rows in substantially equal portions, and the display information is recorded only on the pixel of the (m+1)-th row. Referring to FIGS. 8A and 8C, at interval 2, the signals Scan1[m+1] and Scan1[m+2] are selected among the first scan lines, and the signal Scan2[m+2] is selected among the second scan lines. The other signals are all unselected. At the interval 2, the current Idata of the data line is distributed to the pixels of the (m+1)-th and (m+2)-th rows in substantially equal portions, and the display information is recorded only on the pixel of the (m+2)-th row. Referring to FIGS. 8A and 8D, at interval 3, the signals Scan1[m+2] and Scan1[m+3] are selected among the first scan lines, and the signal Scan2[m+3] is selected among the second scan lines. The other signals are all unselected. At the interval 3, the current Idata of the data line is distributed to the pixels of the (m+2)-th and (m+3)-th rows in substantially equal portions, and the display information is recorded only on the pixel of the (m+3)-th row.

Figure 9A:
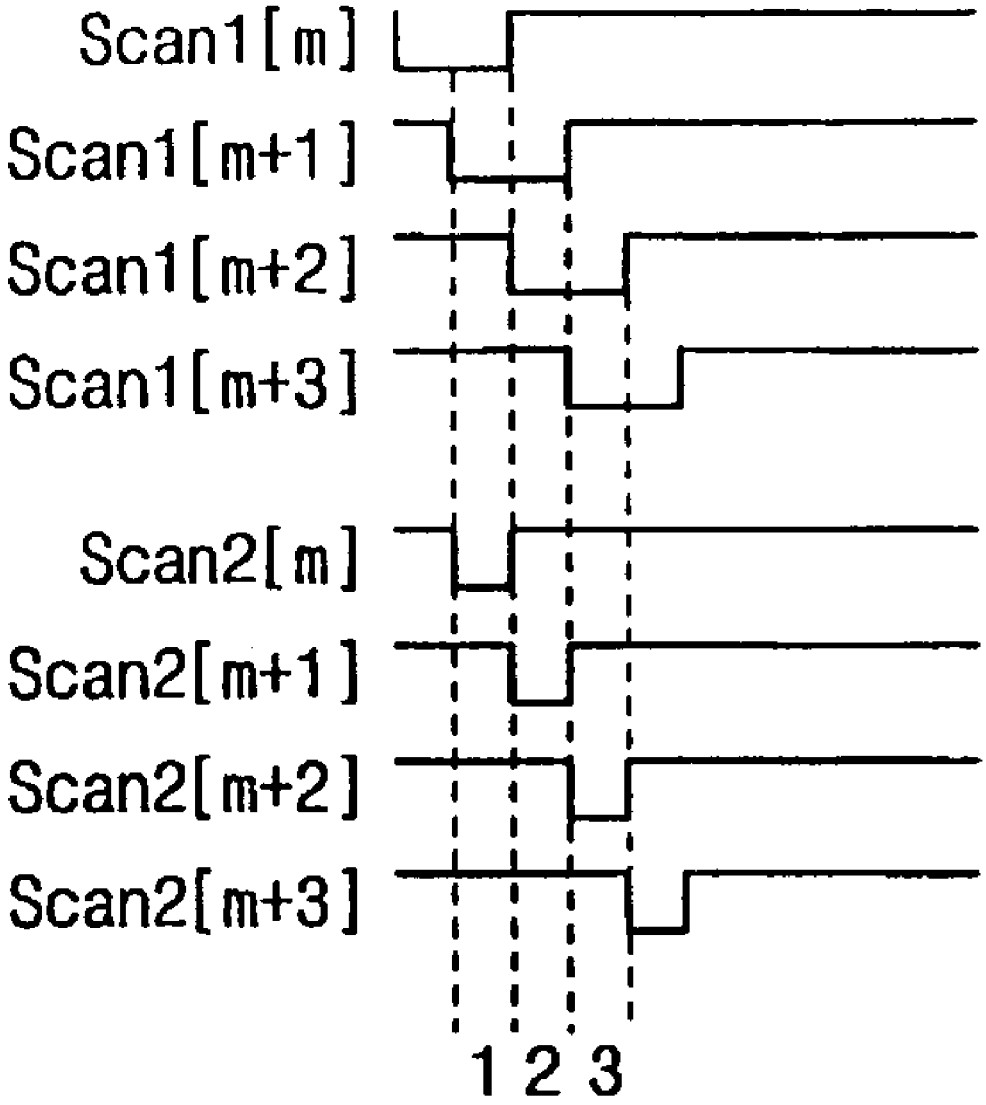
FIGS. 9A to 9D are diagrams for explaining an operation of the circuit of FIG. 5 according to the waveform shown in FIG. 6C.

FIG. 9A shows the waveform of FIG. 6C, and FIGS. 9B, 9C, and 9D show the circuit conditions at the intervals 1, 2, and 3 of FIG. 9A, respectively. In the waveform of FIG. 9A, the first scan lines at the pixels in the m-th and the (m+1)-th rows are selected with an overlap of one recording time, and the second scan line at the pixel of the m-th row is selected during the overlapped time. In other words, according to the waveform of FIG. 9A, the first scan line signal selects the pixels of a row for recording the display information and the next row for one recording time. The second scan line signal sequentially selects the pixel of one row. Unlike the waveform of FIG. 7A, the first scan lines also sequentially select the pixels of two rows. With the above-constructed waveform of the first and second scan lines, the principle of the described exemplary embodiment may be achieved that the pixels of at least two rows are selected and the display information is recorded on the pixel of no more than one row.

Figure 9B:
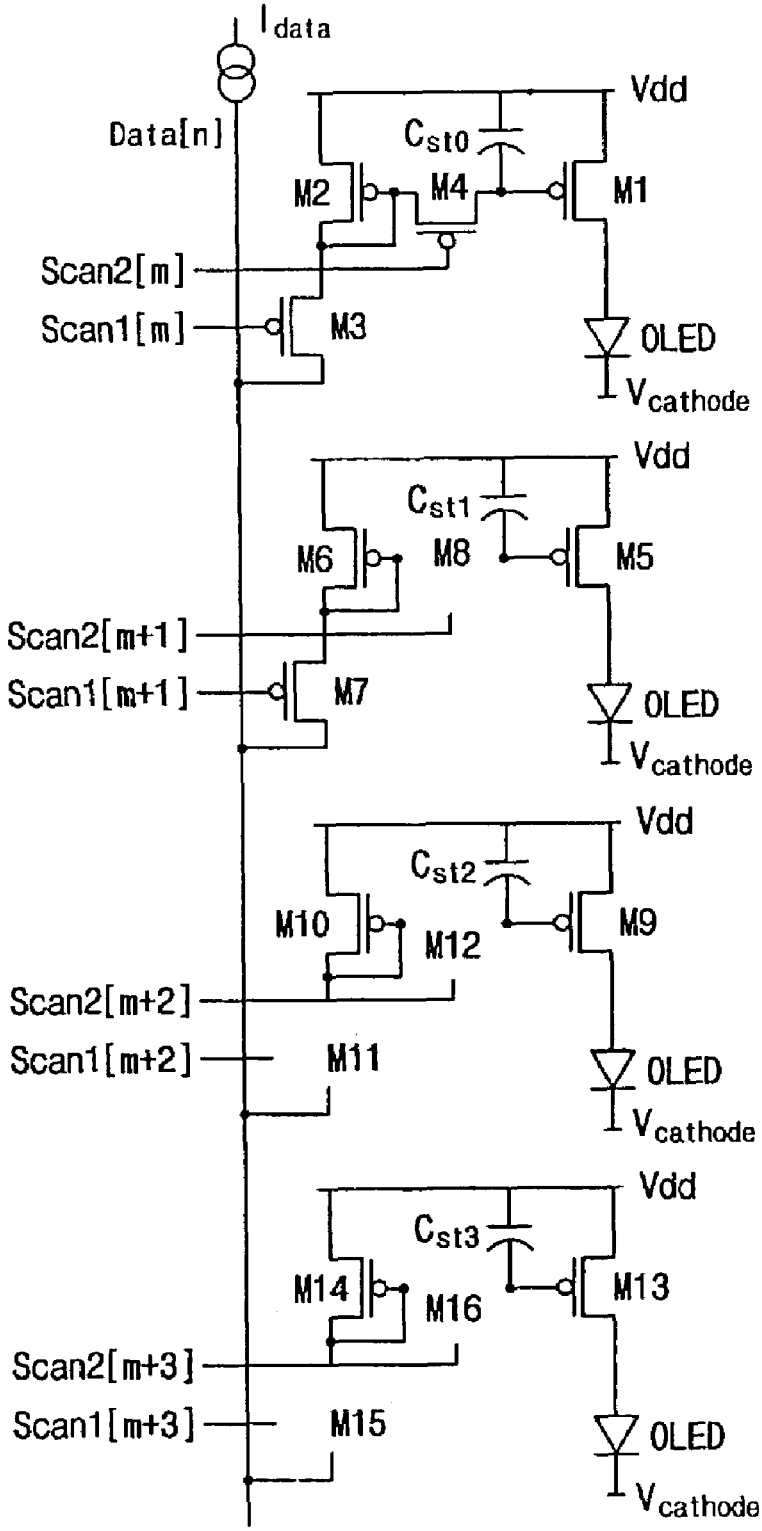
Figure 9C:
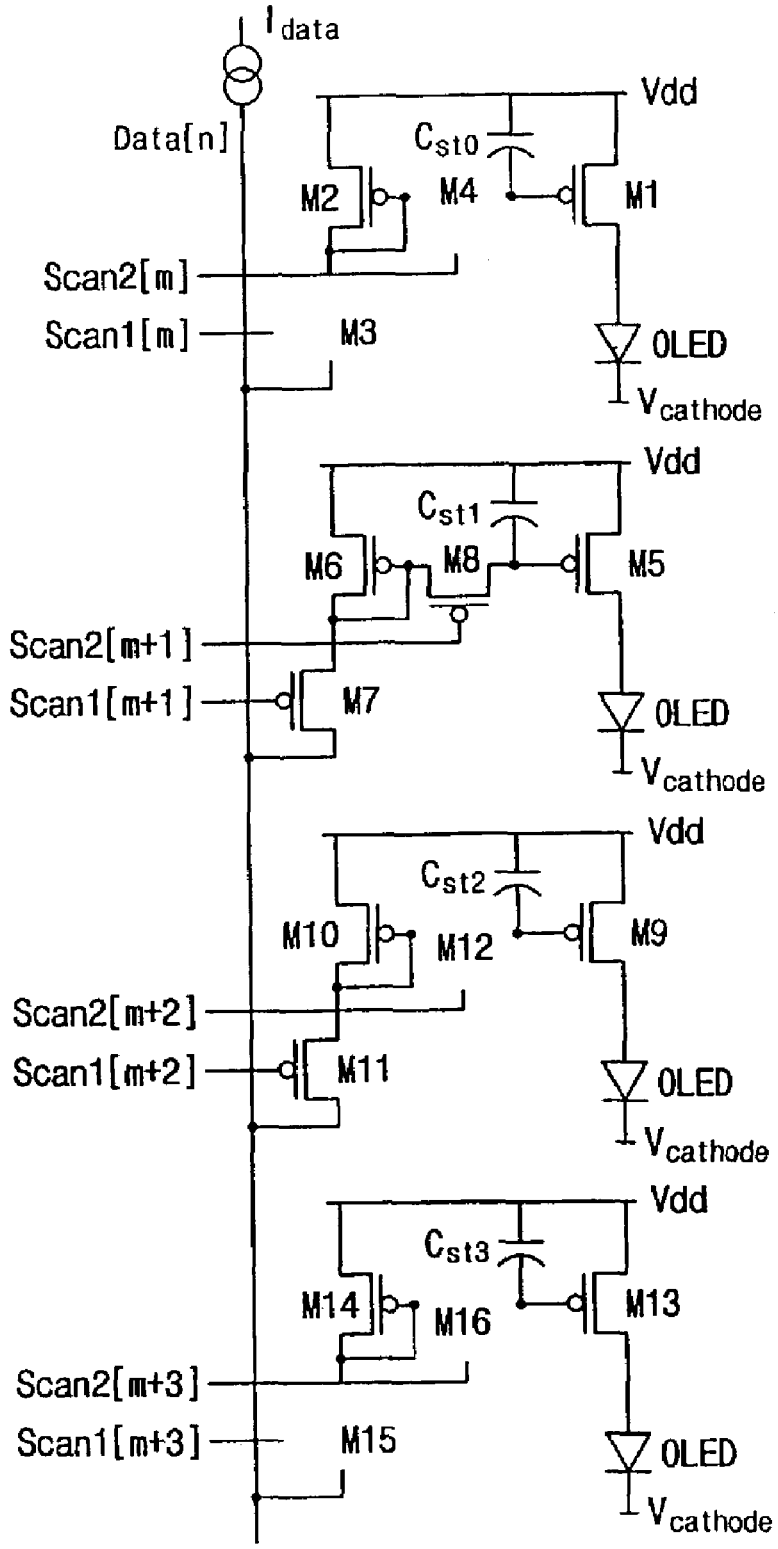
Figure 9D:
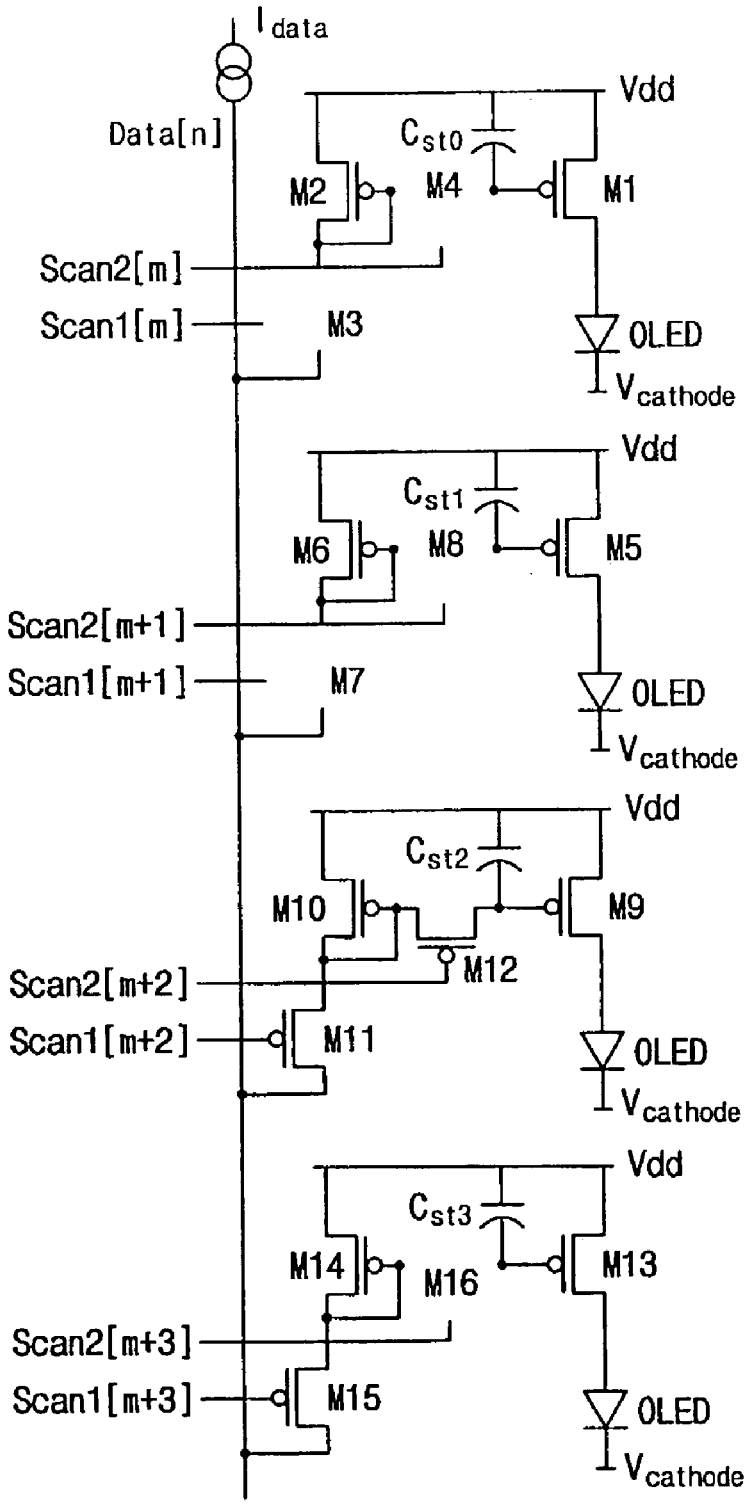

The operation at three intervals of FIG. 9A will now be described in further detail. Referring to FIGS. 9A and 9B, at interval 1, the signals Scan1 [m] and Scan1[m+1] are selected among the first scan lines, and the signal Scan2[m] is selected among the second scan lines. The other signals are all unselected. At the interval 1, the current Idata of the data line is distributed to the pixels of the m-th and (m+1)-th rows in substantially equal portions, and the display information is recorded only on the pixel of the m-th row. Referring to FIGS. 9A and 9C, at interval 2, the signals Scan1[m+1] and Scan1[m+2] are selected among the first scan lines, and the signal Scan2[m+1] is selected among the second scan lines. The other signals are all unselected. At the interval 2, the current Idata of the data line is distributed to the pixels of the (m+1)-th and (m+2)-th rows in substantially equal portions, and the display information is recorded only on the pixel of the (m+1)-th row. Referring to FIGS. 9A and 9D, at interval 3, the signals Scan1[m+2] and Scan1[m+3] are selected among the first scan lines, and the signal Scan2[m+2] is selected among the second scan lines. The other signals are all unselected. At the interval 3, the current Idata of the data line is distributed to the pixels of the (m+2)-th and (m+3)-th rows in substantially equal portions, and the display information is recorded only on the pixel of the (m+2)-th row.

Figure 10:
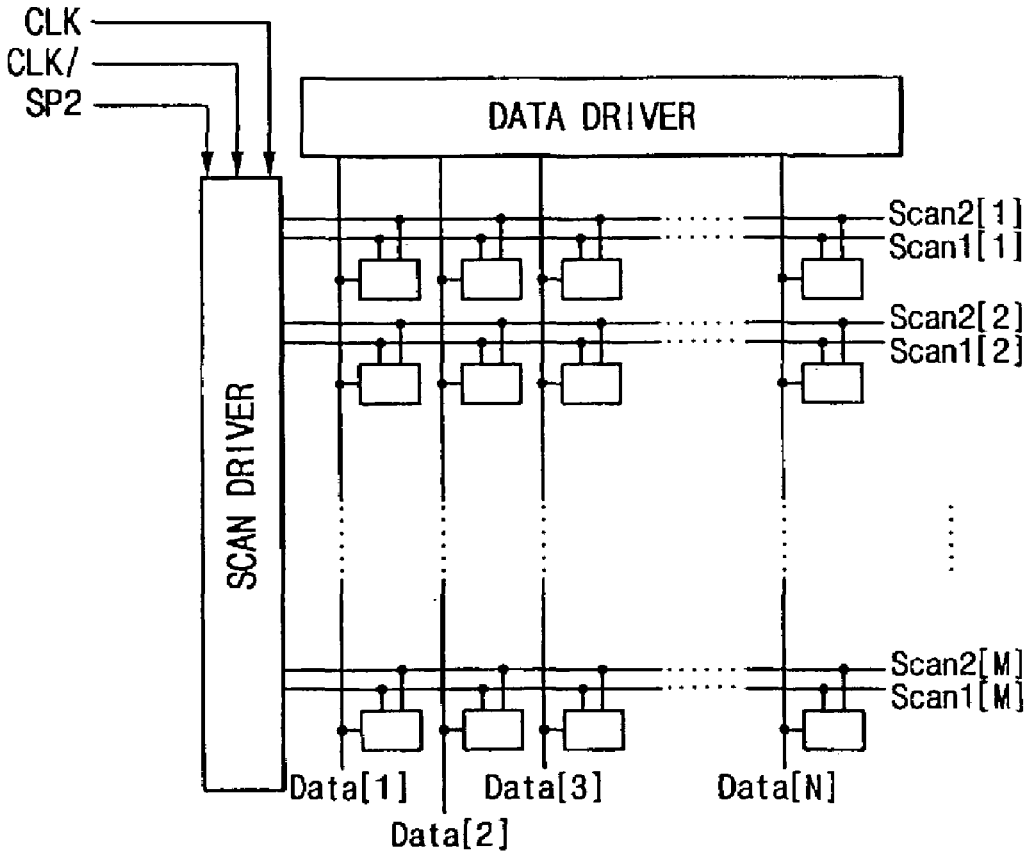
FIG. 10 is a block diagram showing the general construction of an image display apparatus in another exemplary embodiment in accordance with aspects of the present invention.
Figure 11A:
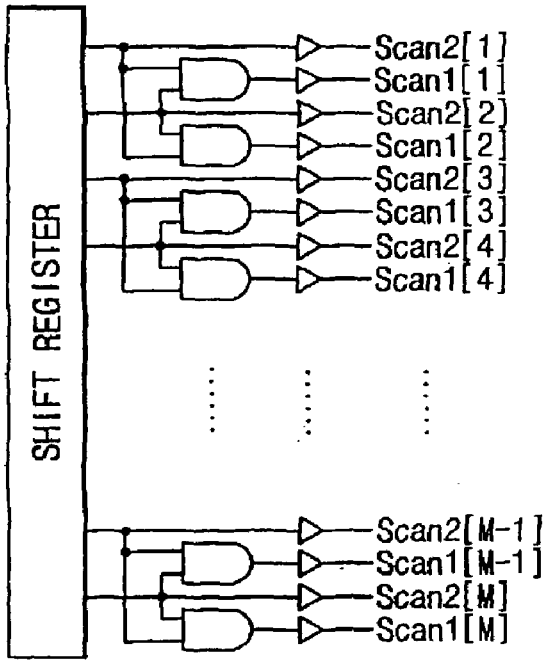
FIGS. 11A, 11B, and 11C are detailed diagrams of the scan driver shown in FIG. 10 for generating the waveforms of FIGS. 6A, 6B, and 6C, respectively.
Figure 11B:
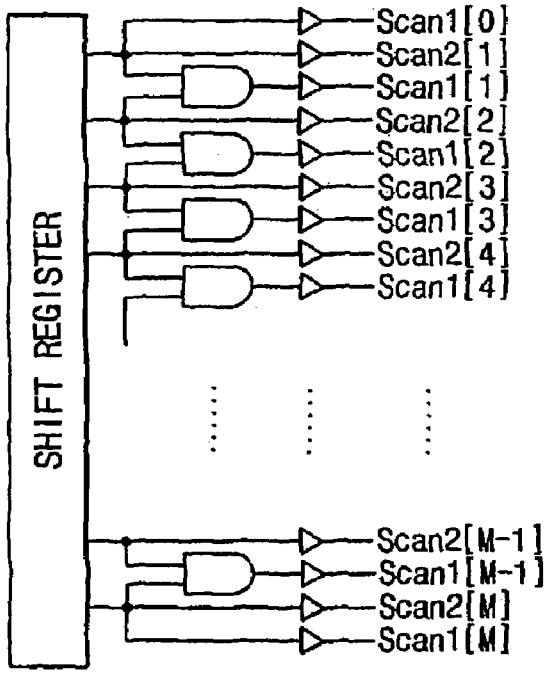
Figure 11C:
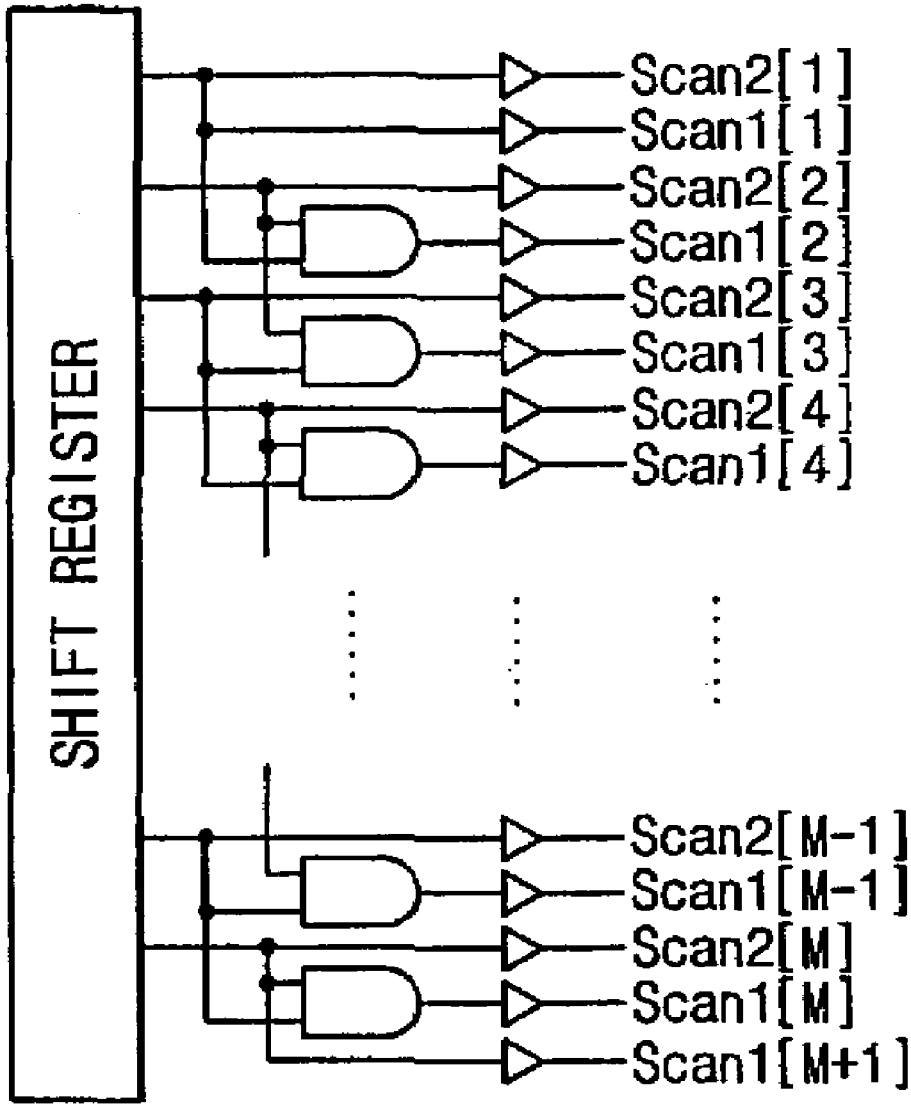

FIG. 10 is a block diagram of the general construction of an image display apparatus in the present invention that does not use a method of adjusting the brightness by discharging the storage capacitor Cst with selection of the second lines. In this case, no more than one shift register is used to construct a scan driver. The scan driver structures shown in FIGS. 11A, 11B, and 11C are used for the waveforms of FIGS. 6A, 6B, and 6C, respectively. Scan1[0] of FIG. 11B and Scan1[M+1] of FIG. 11C represent the first scan lines at the dummy pixels of the first row and the last one role, respectively.

As described above, the image display apparatus in exemplary embodiments in accordance with aspects of the present invention includes transistors that form a current mirror in the pixel and uses a pixel structure having two scan lines, so as to select pixels of at least two rows simultaneously, distribute the current applied to the data line to the pixel for recording display information and the adjacent pixel, and record the display information on the pixel of no more than one row among the selected pixels. This drastically increases the current for driving the data line and decreases the size of the transistors that form the current mirror in the pixel, thereby increasing the aperture ratio of the image display apparatus using organic light-emitting elements.

While this invention has been described in connection with specific exemplary embodiments, it is to be understood that the invention is not limited to the disclosed embodiments, but, on the contrary, is intended to cover various modifications and equivalent arrangements included within the spirit and scope of the appended claims.

What is claimed is:

1. An image display apparatus comprising:

a plurality of data lines for transferring a current including brightness information;

a plurality of scan lines arranged to intersect the data lines;

a plurality of pixels formed in a matrix form having rows and columns, each pixel being located at a different intersection of the data and scan lines, each row of pixels being coupled to corresponding first and second said scan lines, and each column of pixels being coupled to a corresponding one of the data lines, each pixel receiving at least a portion of the current transferred through the corresponding data line when selected by the corresponding first scan line, and performing a display operation according to the current supplied through the corresponding data line when selected by the corresponding second scan line;

a scan driver responsive to a clock signal and a control signal for generating first signals for selecting pixels of at least two consecutive rows simultaneously and second signals for recording the brightness information on the corresponding pixels; and a data driver for generating the current including the brightness information, and applying the generated current to the corresponding data line.

2. The image display apparatus as claimed in claim 1, wherein the first scan line is a scan line for selecting a pixel so as to distribute the current transferred through the corresponding data line, and the second scan line is a scan line for controlling recording of the current transferred through the corresponding data line on the selected pixel.

3. The image display apparatus as claimed in claim 1, wherein the scan driver applies the first signals to the first scan lines corresponding to said at least two consecutive rows, the first signals having waveforms for selecting pixels of said at least two consecutive rows, and the second signals to the second scan lines corresponding to said at least two consecutive rows, the second signals having waveforms for sequentially recording the brightness information on the selected pixels of said at least two consecutive rows.

4. The image display apparatus as claimed in claim 3, wherein the first signals applied to the corresponding first scan lines have a selection time for selecting the pixels of said at least two consecutive rows, and the second signals applied to the corresponding second scan lines have a recording time for sequentially recording the brightness information on the selected pixels of said at least two consecutive rows.

5. The image display apparatus as claimed in claim 4, wherein the selection time of the first signals applied to the first scan lines is at least twice as long as the recording time of the second signals applied to the second scan lines.

6. The image display apparatus as claimed in claim 3, wherein the pixels of said at least two consecutive rows comprise the pixel of a row for recording the display information and the pixel of the previous row or the next row.

7. The image display apparatus as claimed in claim 1, wherein each of the pixels comprises:

a first transistor for providing a current path for distributing the current supplied through the data line;

a second transistor being selected by the first scan line and controlling a current supply between the data line and the first transistor;

a storage capacitor for converting a current flowing through the first transistor to a voltage;

a third transistor being selected by the second scan line and performing a switching function between the first transistor and the storage capacitor;

a fourth transistor for forming a current mirror with the first transistor, and generating a current corresponding to a voltage at the storage capacitor; and a light-emitting element for emitting a light according to a magnitude of the current supplied through the fourth transistor to perform a display operation.

8. The image display apparatus as claimed in claim 7, wherein the light-emitting element includes an organic light-emitting diode.

9. The image display apparatus as claimed in claim 7, wherein the transistors comprise field effect transistors.

10. An image display apparatus comprising:

a plurality of data lines for transferring a current including brightness information;

a plurality of scan lines arranged to intersect the data lines; and a plurality of pixels formed in a matrix form having rows and columns, each pixel being located at a different intersection of the data and scan lines, each row of pixels being coupled to a corresponding one of the scan lines, and each column of pixels being coupled to a corresponding one of the data lines, the pixels performing display operation according to the current supplied through the corresponding data line when selected by the corresponding scan line;

a scan driver responsive to a clock signal and a control signal for generating signals for sequentially selecting the pixel rows during a predetermined time and applying the generated signals to the scan lines respectively; and, a data driver for generating current including the brightness information and applying the generated current to the corresponding data line, wherein the signals generated in the scan driver have an overlapping period for selecting consecutive pixel rows simultaneously, the current generated in the data driver is applied to the consecutive pixel rows, data recording is performed at one pixel row of the consecutive pixel rows and the generated current is distributed in substantially equal portions to the consecutive pixel rows that are selected simultaneously.

11. A method for driving an image display apparatus having a plurality of pixels arranged in a matrix form having rows and columns, comprising:

selecting at least two consecutive pixel rows simultaneously for a first predetermined time period;

selecting said at least two consecutive pixels rows sequentially for a second predetermined time period, which overlaps the first predetermined time period, wherein the second predetermined time period is less than the first predetermined time period;

performing data recording on the pixel row selected during the second predetermined time period; and distributing data current in substantially equal portions to said at least two consecutive pixel rows when said at least two consecutive pixel rows are simultaneously selected.

12. A method of driving an imaging display apparatus comprising a plurality of pixels arranged in a matrix form having rows and columns, said method comprising:

selecting a first row of pixels for a first predetermined time period;

selecting a second row of pixels for a second predetermined time period, wherein the second row is adjacent to the first row, and the first and second predetermined time periods are substantially the same in duration and at least partially overlap with one another;

providing a current containing brightness information to a first pixel on the first row and a second pixel on the second row while the first and second predetermined time periods overlap, wherein the current is distributed to both the first and second pixels; and selecting the first row for a third predetermined time period that overlaps with the first predetermined time period to record the brightness information on the first pixel.

13. The method as claimed in claim 12, wherein the current is distributed to the first and second pixels in substantially equal portions.

14. The method as claimed in claim 12, wherein the first and second predetermined time periods overlap substantially completely with one another, the method further comprising:

providing another current containing another brightness information to the first pixel and the second pixel, wherein said another current is distributed to both the first and second pixels; and selecting a second row for a fourth predetermined time period that overlaps with the second predetermined time period and does not overlap with the third predetermined time period to record said another brightness information on the second pixel.

15. The method as claimed in claim 14, wherein said another current is distributed to the first and second pixels in substantially equal portions.

16. The method as claimed in claim 12, further comprising:

selecting a third row of pixels for a fifth predetermined time period, wherein the third row is adjacent to the first row, and the fifth predetermined time period is substantially the same in duration as and at least partially overlaps with the first predetermined time period;

providing another current containing another brightness information to the first pixel and a third pixel on the third row, wherein said another current is distributed to both the first and third pixels; and selecting the third row for a sixth predetermined time period that overlaps with the fifth predetermined time period and does not overlap with the third predetermined time period to record said another brightness information on the third pixel.

17. The method as claimed in claim 16, wherein said another current is distributed to the first and third pixels in substantially equal portions.

* * * * *